US010539146B2

(12) United States Patent
Nanba

(10) Patent No.: US 10,539,146 B2
(45) Date of Patent: Jan. 21, 2020

(54) CENTRIFUGAL PUMP

(71) Applicant: DENSO CORPORATION, Kariya, Aichi-pref. (JP)

(72) Inventor: Kunio Nanba, Kariya (JP)

(73) Assignee: DENSO CORPORATION, Kariya (JP)

( * ) Notice: Subject to any disclaimer, the term of this patent is extended or adjusted under 35 U.S.C. 154(b) by 230 days.

(21) Appl. No.: 15/575,001

(22) PCT Filed: May 26, 2016

(86) PCT No.: PCT/JP2016/002539
§ 371 (c)(1),
(2) Date: Nov. 17, 2017

(87) PCT Pub. No.: WO2016/194343
PCT Pub. Date: Dec. 8, 2016

(65) Prior Publication Data

US 2018/0135641 A1 May 17, 2018

(30) Foreign Application Priority Data

Jun. 3, 2015 (JP) ..... 2015-112973
Apr. 8, 2016 (JP) ..... 2016-078103

(51) Int. Cl.
*F04D 29/22* (2006.01)
*F04D 29/60* (2006.01)

(52) U.S. Cl.
CPC ..... *F04D 29/22* (2013.01); *F04D 29/60* (2013.01)

(58) Field of Classification Search
CPC ..... F04D 17/10; F04D 29/22; F04D 29/60; F04D 29/20; F04D 29/2216; F04D 29/2255; F04D 29/30; F04D 29/242; F05D 2260/36
USPC ..... 415/203; 416/206, 186 R, 223 B, 243
See application file for complete search history.

(56) References Cited

U.S. PATENT DOCUMENTS 5,106,263 A * 4/1992 Irie ..... F04D 29/2255 415/106
5,407,318 A * 4/1995 Ito ..... F04D 29/188 415/55.1
2018/0163727 A1* 6/2018 McClaran ..... F04D 9/00

FOREIGN PATENT DOCUMENTS

JP 52-138402 U 10/1977
JP 63-277888 11/1988
JP 10-61581 3/1998
JP 2000-192895 7/2000
(Continued)

*Primary Examiner* — J. Todd Newton
(74) *Attorney, Agent, or Firm* — Nixon & Vanderhye P.C.

(57) ABSTRACT

A centrifugal pump includes a motor having a shaft, and an impeller engaged with an end portion of the shaft such that a rotation of the impeller relative to the shaft is limited. The impeller includes a main panel engaged with the shaft, a plurality of passage walls extending from the main panel in an axial direction, a side panel in contact with end surfaces of the passage walls that face away from the main panel, the side panel having an inflow opening at a radially center part, and a fluid passage that is defined by the passage walls adjacent to each other in a circumferential direction, the fluid passage communicating with the inflow opening. The side panel includes an engagement portion configured to be engaged with a fixation jig that limits a rotation of the impeller during fixing the impeller to the shaft by screwing a nut.

20 Claims, 19 Drawing Sheets

(56) References Cited

FOREIGN PATENT DOCUMENTS

| | | |
|---|---|---|
| JP | 2000-192898 | 7/2000 |
| JP | 2005-94983 | 4/2005 |

* cited by examiner

CENTRIFUGAL PUMP

This application is the U.S. national phase of International Application No. PCT/JP2016/002539 filed on May 26, 2016 which designated the U.S. and claims priority to Japanese Patent Applications No. 2015-112973 filed on Jun. 3, 2015 and No. 2016-078103 filed on Apr. 8, 2016, the entire contents of which are hereby incorporated by reference.

CROSS REFERENCE TO RELATED APPLICATION

This application is based on and incorporates herein by reference Japanese Patent Application No. 2015-112973 filed on Jun. 3, 2015, and No. 2016-078103 filed on Apr. 8, 2016.

TECHNICAL FIELD

The present disclosure relates to a centrifugal pump configured to increase a pressure of fluid by using a centrifugal force generated by a rotation of an impeller.

BACKGROUND ART

Patent Document 1 discloses a conventional technology of a centrifugal pump. The centrifugal pump disclosed in Patent Document 1 includes an impeller driven by a motor to rotate, and the impeller is fixed to a shaft of a motor with a screw. When the impeller fixed to the shaft with the screw, the rotation of the shaft or the impeller needs to be limited such that the shaft does not rotate due to screw torque. In Patent Document 1, a fixation hole is formed in the impeller, and a jig is inserted into the fixation hole to limit the rotation of the impeller during screwing.

PRIOR ART DOCUMENT

Patent Document

Patent Document 1: JP H10-61581 A

SUMMARY OF THE INVENTION

Since the centrifugal pump of Patent Document 1 is a vortex pump (cascade pump) having a radial groove in an entire part of an outer peripheral portion of the impeller, a hole for fixation may not be provided in the outer peripheral portion of the impeller in which the groove is formed. That is, a position of the hole for fixation may be limited in an inner peripheral side of the impeller. Accordingly, a jig that is inserted into the hole for fixation may be an obstacle during screwing the impeller to the shaft, and according workability may decrease.

The objective of the present disclosure is to provide a centrifugal pump that is capable of improving workability during fixing an impeller to a shaft of a motor.

A centrifugal pump according to a first aspect of the present disclosure includes a motor that has a shaft, and an impeller that is engaged with an end portion of the shaft such that a rotation of the impeller relative to the shaft is limited, the impeller being fixed to the shaft by screwing a nut, the end portion of the shaft being located on a first side of the shaft. The impeller includes a main panel that is engaged with the shaft, a plurality of passage walls that extend from the main panel in an axial direction, a side panel that is in contact with end surfaces of the plurality of the passage walls that face away from the main panel, the side panel having an inflow opening at a radially center part, and a fluid passage that is defined by two of the plurality of passage walls which are adjacent to each other in a circumferential direction, the two adjacent passage walls being located between the main panel and the side panel, the fluid passage communicating with the inflow opening. The impeller is configured to rotate to intake a fluid into the fluid passage through the inflow opening, a pressure of the fluid taken into the fluid passage being increased by a centrifugal pressure, the fluid being discharged radially outward of the impeller. The side panel includes an engagement portion configured to be engaged with a fixation jig that limits a rotation of the impeller during fixing the impeller to the shaft by screwing the nut.

According to the above-described configurations, the fixation jig is engaged with the engagement portion provided in the side panel to limit the rotation of the impeller during fixing the impeller to the shaft of the motor by screwing the nut, and the shaft is prevented from rotating together with the impeller. Since the engagement portion is provided in the side panel, a tightening torque of the nut is not directly exerted on the passage wall, and accordingly deformation of the passage wall can be prevented. Consequently, the fluid passage defined between the passage walls adjacent to each other in the circumferential direction is not deformed, and the effect of increasing the pressure of the fluid is not affected.

The engagement portion can be positioned anywhere in the side panel, and the position is not limited to the inner peripheral side of the impeller as in Patent Document 1. That is, the engagement portion can be provided so as not to interfere with the screwing of the nut, and workability can be improved.

EMBODIMENTS FOR EXPLOITATION OF THE INVENTION

Figure 1:
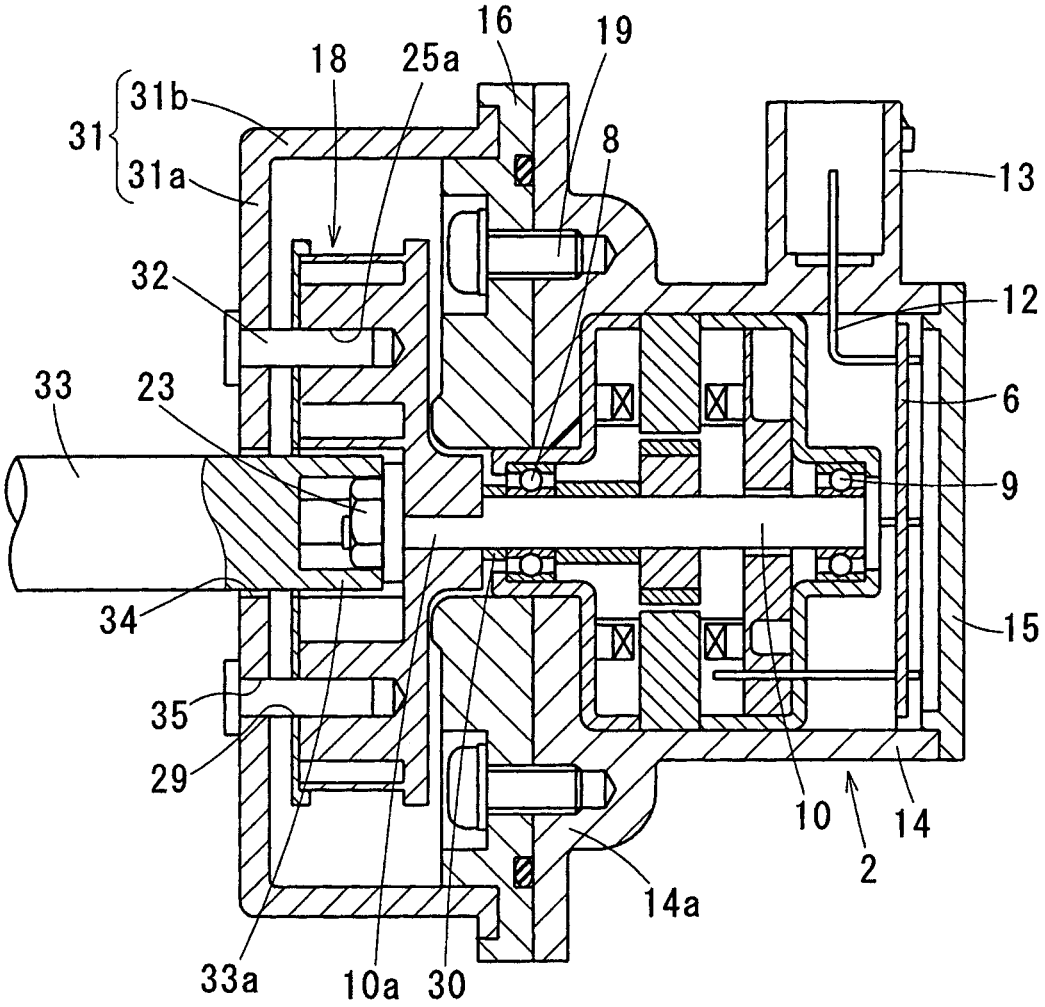
FIG. 1 is a cross-sectional diagram illustrating a situation where an impeller according to a first embodiment of the present disclosure is fixed to a shaft.

Hereinafter, multiple embodiments for implementing the present disclosure will be described referring to drawings. In the respective embodiments, a part that corresponds to a matter described in a preceding embodiment may be assigned the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

Embodiments of the present disclosure will be described below.

[Embodiaments]

(First Embodiment)

Figure 2:
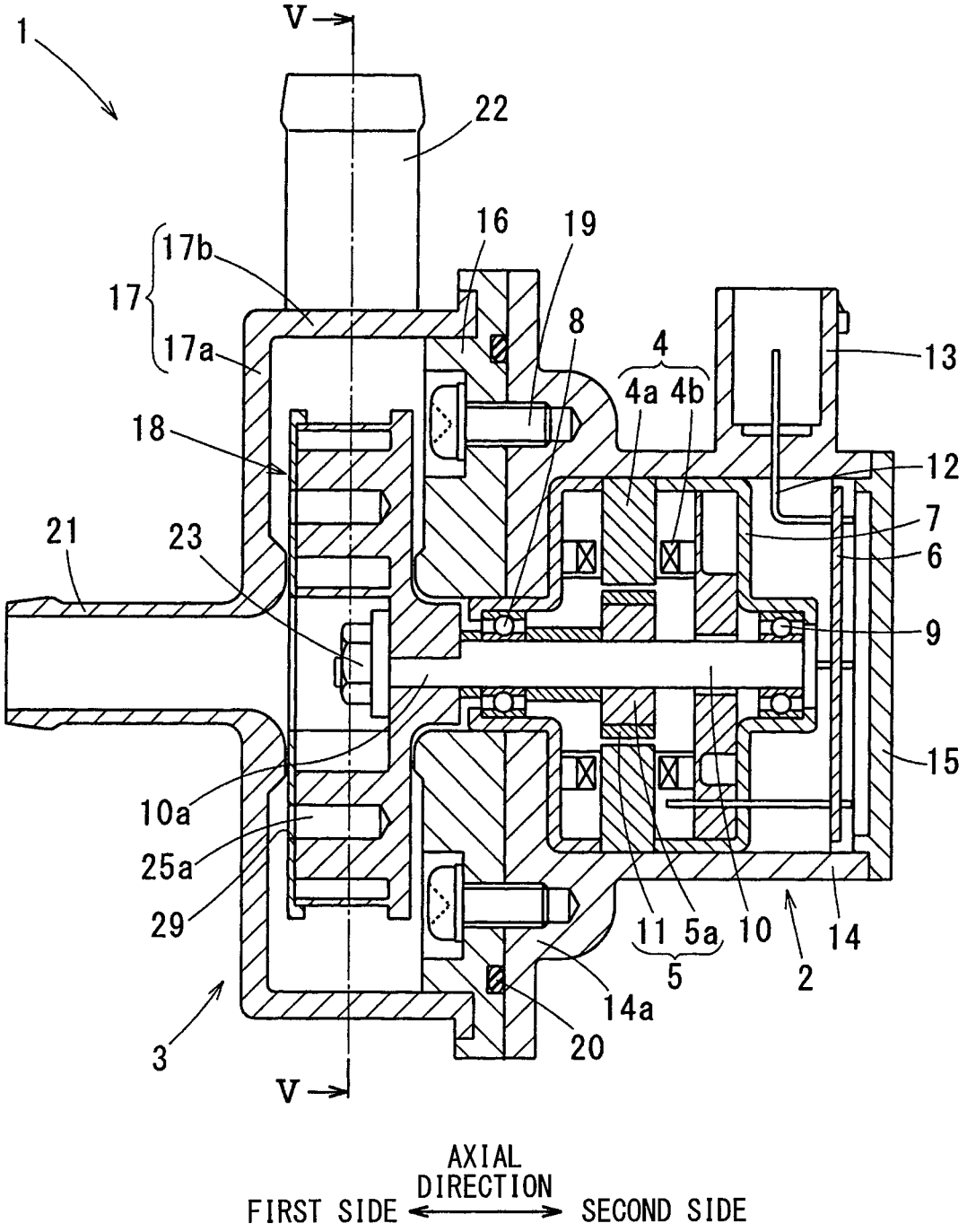
FIG. 2 is a cross-sectional diagram illustrating a centrifugal pump according to the first embodiment.

A centrifugal pump 1 of a first embodiment is constituted by a motor 2 and a pump assembly 3, and the centrifugal pump 1 can be used as a purge pump of a gasoline engine. Hereinafter, a left-right direction in FIG. 2 is defined as an axial direction of the centrifugal pump 1. The left side of the axial direction in the drawings is defined as a first side, and the right side is defined as a second side. A stator 4, a rotor 5, and a substrate 6 including a circuit for driving the motor 2, for example, are housed in a motor housing to constitute the motor 2.

The stator 4 includes a stator core 4*a* supported by a metal frame 7 and a stator wire 4*b* wound around the stator core 4*a*. Three-phase electric power is supplied to the stator wire 4*b* through the substrate 6, and the stator 4 generates a rotating magnetic field. The rotor 5 includes a shaft 10 supported by the frame 7 through a pair of bearings 8, 9, and a rotor core 5*a* in which multiple permanent magnets 11 is embedded, and the rotor 5 rotates according to the rotating magnetic field around the stator 4. The substrate 6 is located in the motor housing on the second side to be perpendicular to the axial direction, and electricity is supplied to the substrate 6 from outside through the terminal 12. One end portion of the terminal 12 is connected to the substrate 6, and the other end portion is located inside a connector body 13. The connector body 13 is provided integrally with a housing body 14.

The motor housing includes the housing body 14, which has a motor base portion 14*a* on a first side and an opening portion on a second side, and an end cover 15 that airtightly closes the opening portion of the housing body 14. An end surface of the motor base portion 14*a* on the first side is provided as a flat surface that is perpendicular to the axial direction. A circular cylindrical hole extending through a radial center part of the motor base portion 14*a* in the axial direction is provided, and the bearing 8 supporting the first side of the shaft 10 is provided in the inner periphery of the circular cylindrical hole. An end portion of the shaft 10 on the first side protrudes into the pump assembly 3 through the bearing 8.

The pump assembly 3 includes a pump base portion 16 fixed to the motor base portion 14*a*, a pump casing 17 bonded to the pump base portion 16 by adhering or welding, and an impeller 18 housed in the pump casing 17.

An end surface of the pump base portion 16 on the second side is a flat surface perpendicular to the axial direction, and the flat surface is in contact with the flat surface of the motor base portion 14*a* and is fixed to the motor base portion 14*a* by a screw 19. A sealing groove is formed in an entire part of the periphery of the flat surface of the pump base portion 16, and an interface between the flat surface of the pump base portion 16 and the flat surface of the motor base portion 14*a* is airtightly sealed by a sealing member 20 such as an O-ring fitted in the sealing groove. A cylindrical hole, which has the same inner diameter as the cylindrical hole of the motor base portion 14*a* and extends through the pump base portion 16 in the axial direction, is provided at a center part of the pump base portion 16.

The pump casing 17 includes a lateral wall portion 17*a*, which has a disc shape and covers the first side of the impeller 18, and a peripheral wall portion 17*b*, which has a circular cylindrical shape extending from an outer periphery of the lateral wall portion 17*a* toward the second side in the axial direction and covers the outer periphery of the impeller 18. The peripheral wall portion 17*b* has a circular cylinder shape. An end portion in the axial direction of the peripheral wall portion 17*b* is connected to the pump base portion 16.

An inflow port 21 through which a fluid flows into the pump casing 17 and an outflow port 22 through which the fluid flows out of the pump casing 17 is provided in the pump casing 17. The inflow port 21 is provided at a center part of the lateral wall portion 17*a* and has a pipe shape extending from the lateral wall portion 17*a* toward the first side in the axial direction. The outflow port 22 is provided in the peripheral wall portion 17*b* and has a pipe shape extending along a normal line of the peripheral wall portion 17*b*.

Figure 3:
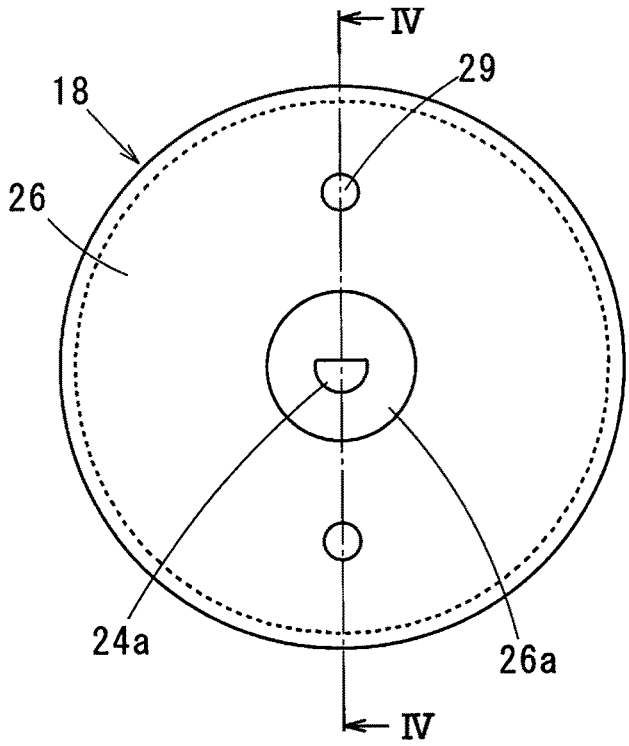
FIG. 3 is a plan view illustrating the impeller according to the first embodiment.
Figure 4:
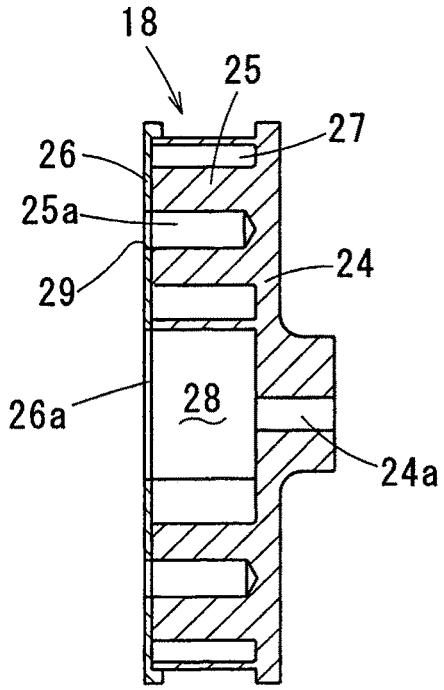
FIG. 4 is a cross-sectional diagram taken along IV-IV line of FIG. 3.

The impeller 18 is engaged with the end portion of the shaft 10 on the first side and fixed to the shaft 10 by screwing a nut 23. As shown in FIGS. 3 and 4, the impeller 18 is constituted by a main panel 24 having a disc shape, multiple passage walls 25 provided integrally with the main panel 24, and a side panel 26 located on an opposite side of the passage walls 25 opposite from the main panel and having a disc shape. The impeller 18 is suitably used in the centrifugal pump 1 having a low specific speed.

An engagement hole 24*a* is provided at a radial center part of the main panel 24, and the end portion of the shaft 10 on the first side is engaged with the engagement hole 24*a*, and accordingly the main panel 24 is engaged with the shaft 10. For example, the engagement hole 24*a* is a D-cut hole whose inner peripheral shape has a D-shape, as shown in FIG. 3. An outer peripheral shape of the end portion of the shaft 10 on the first side is formed into a D-shape corresponding to the D-cut hole. Hereinafter, the part of the shaft 10 shaped into the D-shape is referred to as a D-cut portion 10*a* (see FIG. 1).

A position of the impeller 18 regarding a rotational direction relative to the shaft 10 is fixed by engaging the D-cut portion 10*a* with the engagement hole 24*a* (D-cut hole) of the main panel 24. Accordingly, a relative rotational motion of the shaft 10 to the impeller 18 is limited. A male thread portion for screwing the nut 23 is provided on the end portion of the shaft 10 extending from the D-cut portion 10*a* of the shaft 10.

A configuration for limiting the relative rotation of the shaft 10 and the impeller 18 may be a combination of a distance across flats of the inner periphery of the engagement hole 24*a* and a distance across flats of the outer periphery of the shaft 10, instead of the combination of the D-cut hole and the D-cut portion 10*a*. The relative rotation of the impeller 18 and the shaft 10 may be limited by using a locating pin.

Figure 5:
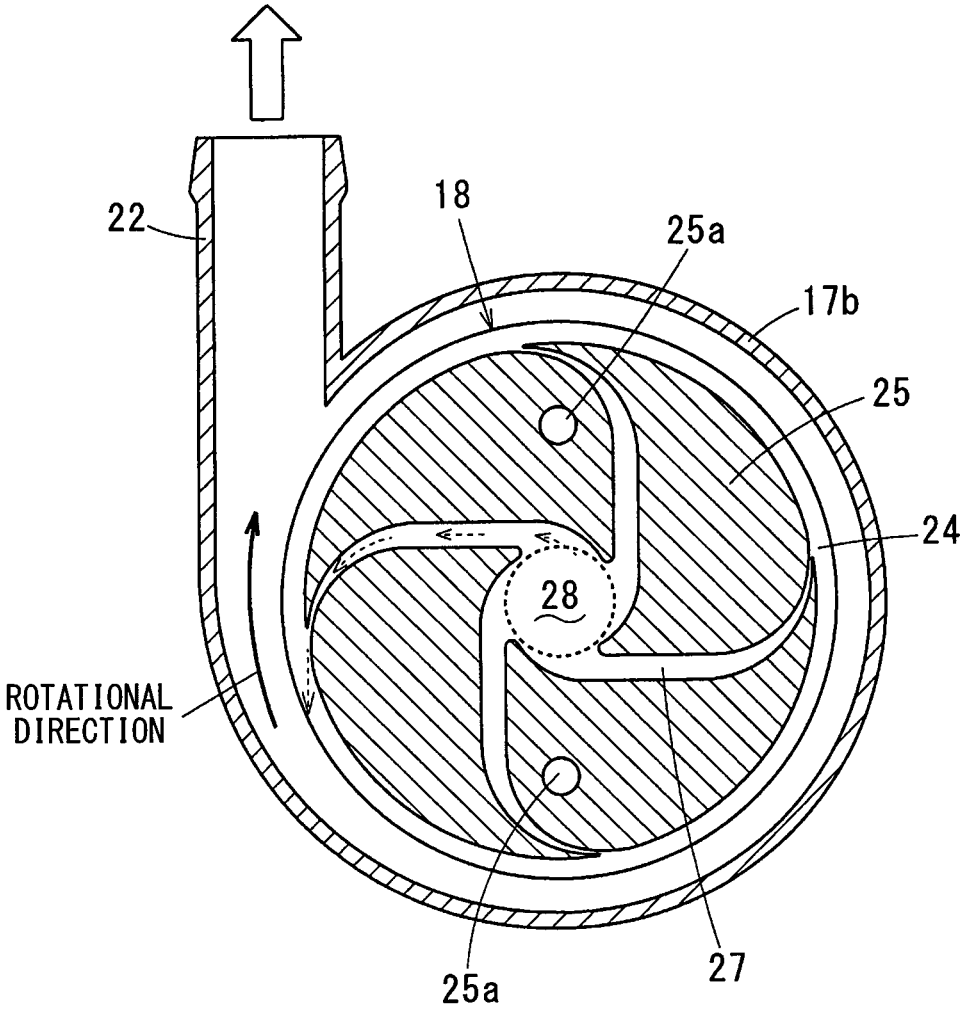
FIG. 5 is a cross-sectional diagram taken along V-V line of FIG. 2.

As shown in FIG. 5, four passage walls 25 are provided at intervals in a circumferential direction of the main panel 24, and a fluid passage 27 is defined between passage walls 25 next to each other in the circumferential direction. An inlet space 28 defined inside the passage walls 25 communicates, through the fluid passage 27, with an annular space defined between the passage walls 25 and the peripheral wall portion 17*b* of the pump casing 17. Dashed arrows shown in FIG. 5 represent a direction in which the fluid flows in the fluid passage 27 by a rotation of the impeller 18. Solid arrows shown in the drawings represent the rotational direction of the impeller 18.

The side panel 26 is attached to an end surface of each passage walls 25 that faces away from the main panel to close an opposite side of the fluid passage 27 opposite from the main panel. Accordingly, a first side of the fluid passage 27 is closed by the side panel 26, and a second side of the fluid passage 27 is closed by the main panel 24. An inflow opening 26*a* (see FIGS. 3, 4) through which the inflow port 21 communicates with the inflow space 28 is provided at a center part of the side panel 26, and the inflow opening 26*a* is an entrance of the impeller 18 for the fluid. The fluid flowing due to the rotation of the impeller 18 flows from the inflow port 21 into the inflow space 28 through the inflow opening 26*a*, and a pressure of the fluid increases when the fluid flows through the fluid passage 27 due to the centrifugal forth. The fluid is discharged through the outflow port 22 after flowing out from the fluid passage 27 to the outer peripheral side of the impeller 18.

Figure 6:
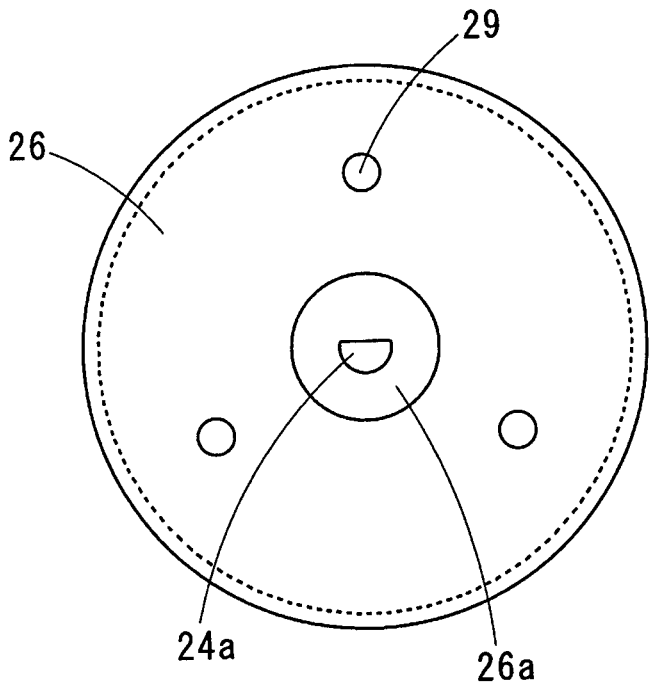
FIG. 6 is a plan view illustrating the impeller according to the first embodiment.
Figure 7:
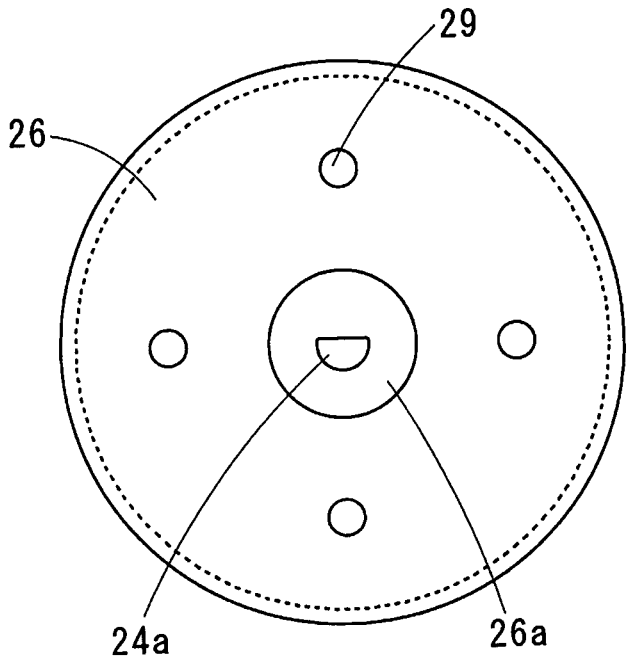
FIG. 7 is a plan view illustrating the impeller according to the first embodiment.

The impeller 18 of the first embodiment includes an engagement portion that limits the rotation of the impeller 18. The engagement portion is engaged with a fixation jig when the impeller 18 is fixed by screwing the nut 23 to the male thread portion of the shaft 10. The engagement portion is a side panel hole 29 extending through the side panel 26 in a thickness direction of the side panel 26. For example, two side panel holes 29 are provided at positions 180-degree different from each other, as shown in FIG. 3. The number of the side panel hole 29 is not limited to two, and three, four, five or more side panel holes may be provided as shown in FIGS. 6, 7. Multiple side panel holes 29 are preferred to be arranged at regular intervals in the circumferential direction so as to keep a rotation balance of the impeller 18. The engagement portion may be a side panel hole 29 extending through the side panel 26 in the axial direction of the impeller 18. An axial hole 25*a* drilled from an end surface of the passage wall 25 opposite from the main panel is provided in the passage wall 25, and the axial hole 25*a* communicates with the side panel hole 29. The axial hole 25*a* can be used as the above-described engagement portion together with the side panel hole 29. An inner diameter of the axial hole 25*a* is the same as or slightly larger than that of the side panel hole 29.

Next, the procedure for fitting together the motor 2 and the pump assembly 3 will be described. The motor 2 is preliminarily assembled by manufacturer. The pump base portion 16, the impeller 18, and the pump casing 17 of the pump assembly 3 is fitted to the motor 2 in this order. The pump base portion 16 is fixed to the motor base portion 14*a* by tightening the screw 19. The pump base portion 16 may be provided as a part of the motor base portion 14*a*. The engagement hole 24*a* of the main panel 24 is engaged with the D-cut portion 10*a* of the shaft 10, and accordingly the impeller 18 is fitted to the shaft 10. A motion of the impeller 18 toward the second side of the axial direction is limited by a spacer 30 (see FIG. 1) interposed between the impeller 18 and the bearing 8. When the nut 23 is screwed to the male thread portion of the shaft 10, a rotation of the impeller 18 is limited by the fixation jig described below such that the shaft 10 is rotated by a tightening torque of the nut 23.

The fixation jig includes a jig cover 31 that has a shape similar to the pump casing 17 excepting the inflow port 21 and the outflow port 22 as shown in FIG. 1, and a jig pin 32 attached to the jig cover 31.

The jig cover 31 includes a flat plate portion 31*a* corresponding to the lateral wall portion 17*a* of the pump casing 17, and a circular cylinder portion 31*b* corresponding to the peripheral wall portion 17*b* of the pump casing 17. An axial end portion of the circular cylinder portion 31*b* is fitted to the pump base portion 16 such that a rotation of the circular cylinder portion 31*b* relative to the pump base portion 16 is limited. A jig insertion hole 34 into which a nut fastening jig 33 is inserted is provided at a radial center part of the flat plate portion 31*a*, and a pin attachment hole 35 in which the jig pin 32 is fitted is provided in radially outer part of the jig insertion hole 34. Two pin attachment holes 35 are provided at positions 180-degree different from each other, the positions are the same as the side panel hole 29 and the axial hole 25*a* in a radial direction.

The nut fastening jig 33 includes a socket portion that has a box shape defining a hexagonal hole, for example, and the nut 23 is tightened by rotating the nut fastening jig 33 in the situation where the hexagonal hole of the socked portion 33*a* is engaged with an outer periphery of the nut 23. The jig pin 32 is fixed to the pin attachment hole 35 by press-fitting, for example, and an end portion of the jig pin 32 protruding from the pin attachment hole 35 into an inside of the jig cover 31 is configured to be inserted into the side panel hole 29 and the axial hole 25*a*.

Since the rotation of the impeller 18 relative to the shaft 10 is limited, the rotation of the shaft 10 is limited by limiting the rotation of the impeller 18 by inserting the jig pin 32 into the side panel hole 29 and the axial hole 25*a*. Subsequently, the shaft 10 is fixed to the impeller 18 by screwing the nut 23 with the nut fastening jig 33. Lastly, the fixation jig is detached, and the pump casing 17 is attached to the pump base portion 16 to complete the assembly of the pump assembly 3.

(Effects of First Embodiment)

In the centrifugal pump 1 of the first embodiment, since the rotation of the impeller 18 is limited by inserting the jig pin 32 into the side panel hole 29 and the axial hole 25*a*, the rotation of the shaft 10 can be limited when the impeller 18 is fixed to the shaft 10 with the nut 23. The axial hole 25*a* provided in the passage wall 25 does not overlap the fluid passage 27 defined between the passage walls 25. That is, the axial hole 25*a* does not communicate with the fluid passage 27. Accordingly, the axial hole 25*a* provided in the passage wall 25 does not decrease the effect for increasing the pressure of the fluid flowing through the fluid passage 27.

The positions of the side panel hole 29 and the axial hole 25*a* are not limited to the inner peripheral side of the impeller 18. The side panel hole 29 and the axial hole 25*a* can be located at positions where the side panel hole 29 and the axial hole 25*a* do not interfere with the tightening of the nut 23, and accordingly the workability can be improved.

When the impeller 18 is fixed to the shaft 10 with the nut 23, it is not necessary to work on both sides in the axial direction. That is, the operation for tightening of the nut 23 after attaching the impeller 18 to the shaft 10 and the operation for limiting the rotation of the impeller 18 by inserting the jig pin 32 into the side panel hole 29 and the axial hole 25*a* can be done on the same side (first side) in the axial direction, and accordingly workability can be improved.

Since the motor 2 produced by a manufacturer and having a guaranteed quality can be used in the centrifugal pump 1 of the first embodiment, a performance check of the motor 2 in which end cover 15 is detached after fixing the impeller 18 to the shaft 10 by the nut 23 is not needed. Consequently, the assembling step of the centrifugal pump 1 can be simplified, and a cost of defects can be reduced due to decrease of defective rate.

Hereinafter, other embodiments of the present disclosure will be described.

A part that corresponds to a matter described in the first embodiment may be assigned the same reference numeral as the first embodiment, and redundant explanation for the part may be omitted.

(Second Embodiment)

Figure 8:
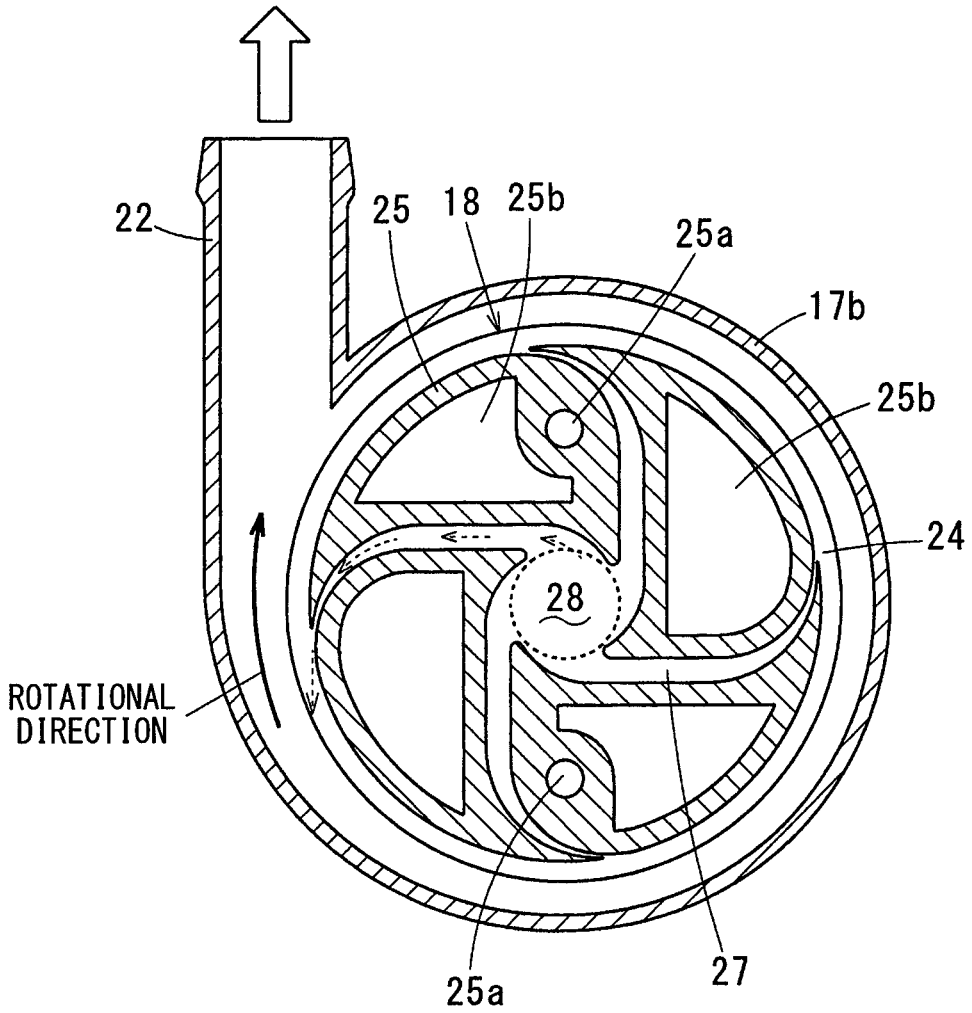
FIG. 8 is a cross-sectional diagram illustrating a pump assembly according to a second embodiment of the present disclosure.

A centrifugal pump 1 of a second embodiment includes a bored space 25*b* provided in the passage wall 25 as shown in FIG. 8. The bored space 25*b* is a space formed by partially removing a material of the passage wall 25. The bored space 25*b* is a closed space, and an outer shape of the passage wall 25 and a shape of the fluid passage 27 are not affected by the bored space 25*b*. Required stiffness of the passage wall 25 is secured. The bored space 25*b* is provided in a part where the axial hole 25*a* is not provided. That is, the bored space 25*b* is provided such that an annular wall portion remains around the axial hole 25*a*. The bored space 25*b* may be provided inside the passage wall 25.

According to the centrifugal pump 1 of the second embodiment, since the rotation of the impeller 18 is limited by inserting the jig pin 32 into the side panel hole 29 and the axial hole 25*a* as in the first embodiment, the rotation of the shaft 10 can be limited when the impeller 18 is fixed to the shaft 10 with the nut 23. Accordingly, the same effects as the first embodiment can be obtained. Moreover, since the weight of the impeller 18 can be reduced by providing the bored space 25*b* in the passage wall 25, electric consumption of the motor 2 can be reduced, and accordingly an energy saving effect can be obtained.

Since the annular wall portion remains around the axial hole 25*a* even when the bored space 25*b* is provided in the passage wall 25, a deformation of the side panel 26 during inserting the jig pin 32 into the side panel hole 29 can be limited, for example.

(Third Embodiment)

Figure 9:
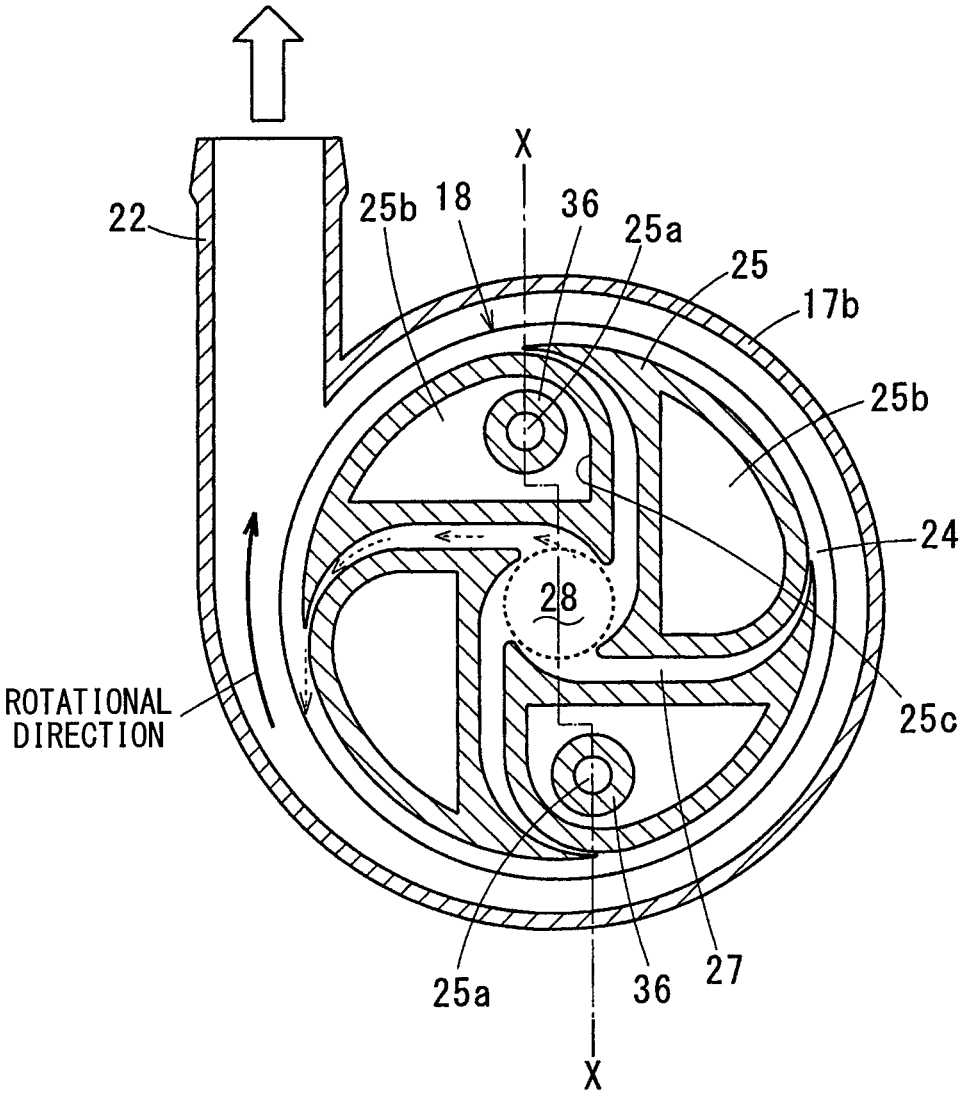
FIG. 9 is a cross-sectional diagram illustrating a pump assembly according to a third embodiment of the present disclosure.
Figure 10:
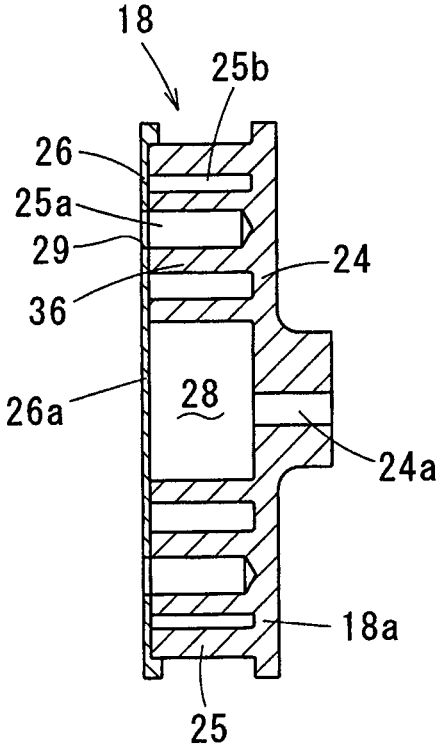
FIG. 10 is a cross-sectional diagram taken along X-X line of FIG. 9.

A centrifugal pump 1 of a third embodiment includes a bored space 25*b* in the passage wall 25 similarly to the second embodiment. The third embodiment is different from the second embodiment in a point where a rib wall 36 having a circular cylinder shape is provided inside the bored space 25*b* as shown in FIG. 9, and an inside space of the rib wall 36 is used as the axial hole 25*a*. The rib wall 36 can be provided integrally with the main panel 24 as shown in FIG. 10, and an end surface of the rib wall 36 opposite from the main panel is in contact with the side panel 26. The rib wall 36 is spaced away from a wall surface defining the bored space 25*b* as shown in FIG. 9. That is, a clearance is secured between the wall surface defining the bored space 25*b* and the rib wall 36. Hereinafter, the wall surface defining the bored space 25*b* is referred to as an inner wall surface 25*c*.

According to the above-described configurations, since the rib wall 36 is capable of receiving a tightening torque of the nut 23 when the impeller 18 is fixed to the shaft 10 with the nut 23, the stress is not exerted on the inner wall surface 25*c*, and accordingly a deformation of the passage wall 25 can be prevented. Moreover, since a deformation of the of the fluid passage 27 is necessarily prevented due to the prevention of the deformation of the passage wall 25, an effect of increasing a pressure of the fluid flowing through the fluid passage 27 is not decreased. Since the rib wall 36 extends inside the bored space 25*b* such that the end surface of the rib wall 36 opposite from the main panel is in contact with the side panel 26, a deformation of the side panel 26 is also prevented.

(Fourth Embodiment)

Figure 11:
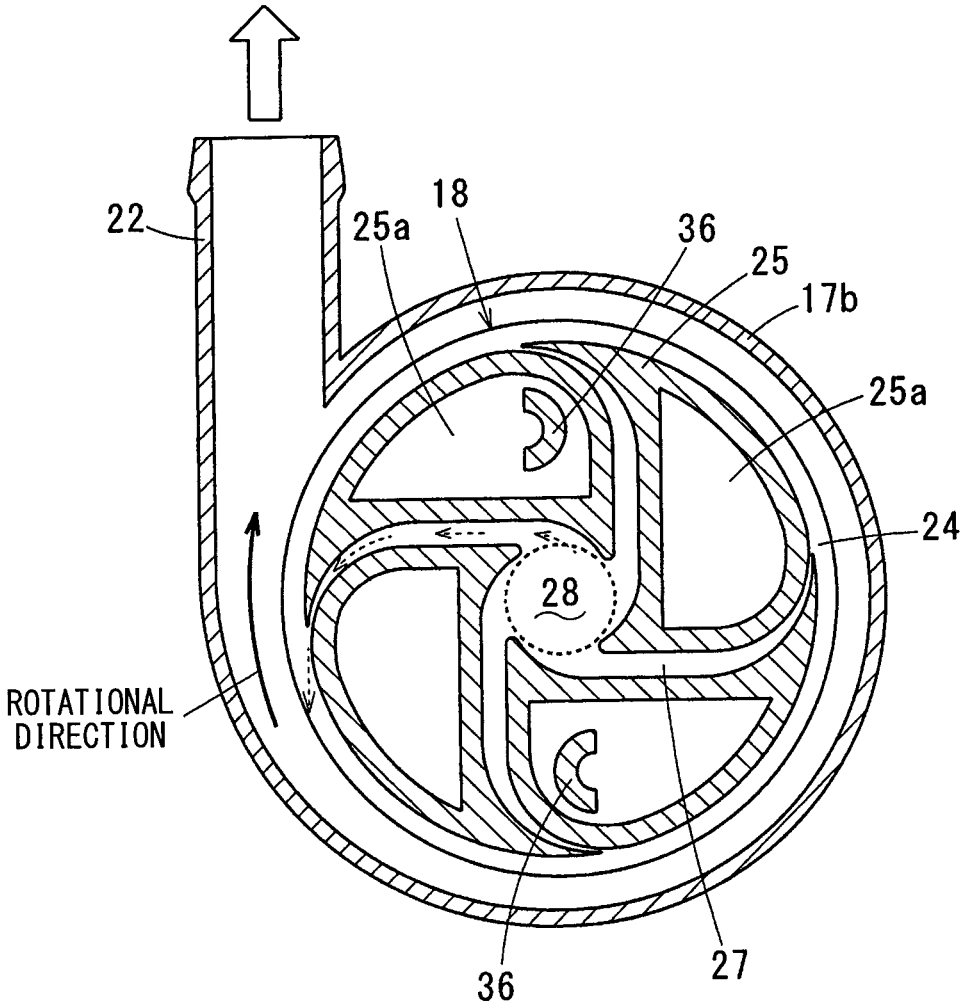
FIG. 11 is a cross-sectional diagram illustrating a pump assembly according to a fourth embodiment of the present disclosure.

In the centrifugal pump 1 of a fourth embodiment, the rib wall 36 extends inside the bored space 25*b* similarly to the third embodiment. The fourth embodiment is different from the third embodiment in that the rib wall 36 does not have a circular cylinder shape, and the rib wall 36 is provided only on a side which receives the tightening torque of the nut 23, as shown in FIG. 11. The tightening torque of the nut 23 is exerted in an opposite direction from the rotational direction of the impeller 18 represented by a solid arrow in FIG. 11 (counterclockwise in the drawings). The rib wall 36 shown in FIG. 11 has an arc shape but does not limited to an arc shape, and any shape capable of receiving the tightening torque of the nut 23 is acceptable. The fourth embodiment is different from the third embodiment only in the shape of the rib wall 36, and the same effects as the third embodiment can be obtained.

(Fifth Embodiment)

Figure 12:
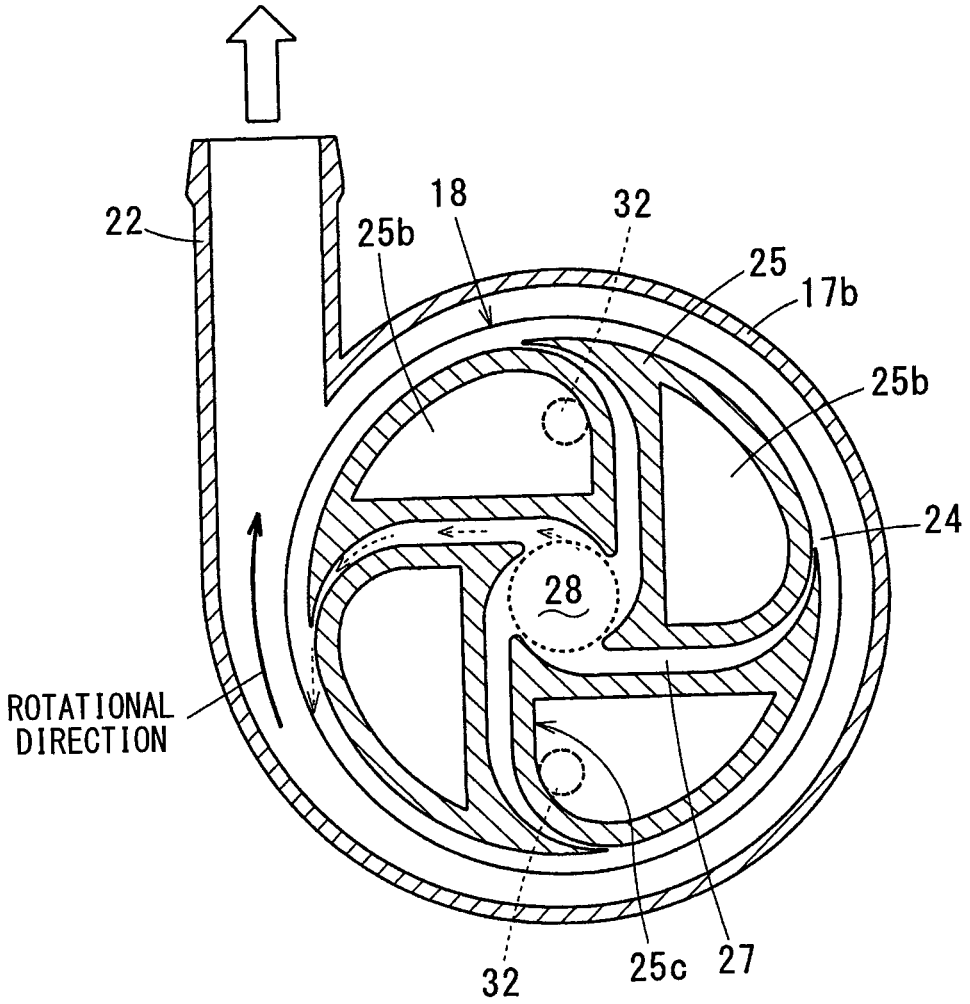
FIG. 12 is a cross-sectional diagram illustrating a pump assembly according to a fifth embodiment of the present disclosure.

In the centrifugal pump 1 of a fifth embodiment, the inner wall surface 25*c* of the bored space 25*b* has a function of the rib wall 36 instead of providing the rib wall 36 described in the third and the fourth embodiments. That is, a part of an outer periphery of the jig pin 32 contacts the inner wall surface 25*c*, as shown in FIG. 12. In this case, since it is not necessary to provide the rib wall inside the bored space 25*b*, the weight of the impeller 18 can be further reduced.

The passage wall 25 that includes the rib wall 36 inside the bored space 25*b* and the passage wall 25 that does not include the rib wall 36 inside the bored space 25*b* are not mixed, and all of four passage walls 25 have the same shape. Accordingly, the impeller 18 having a good balance of rotation is provided.

(Sixth Embodiment)

Figure 13:
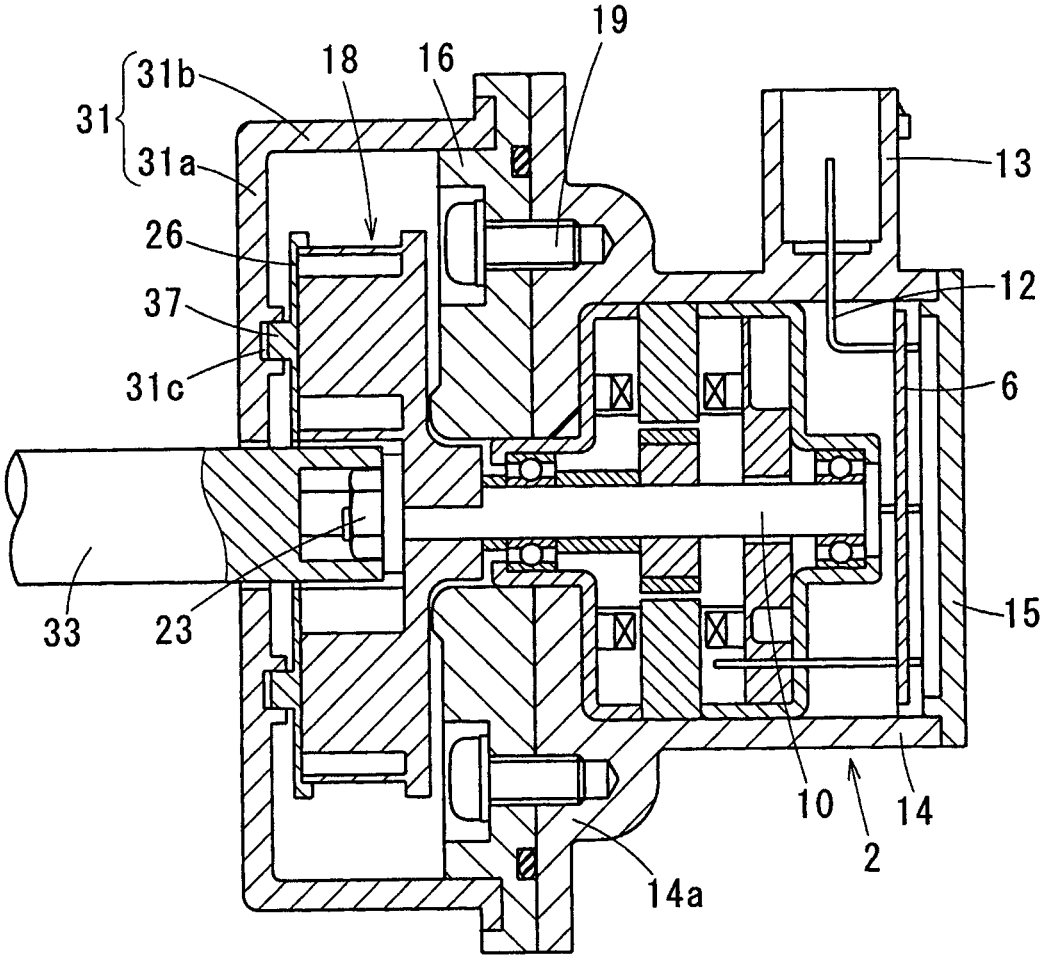
FIG. 13 is a cross-sectional diagram illustrating a situation where an impeller according to a sixth embodiment of the present disclosure is fixed to a shaft.
Figure 14:
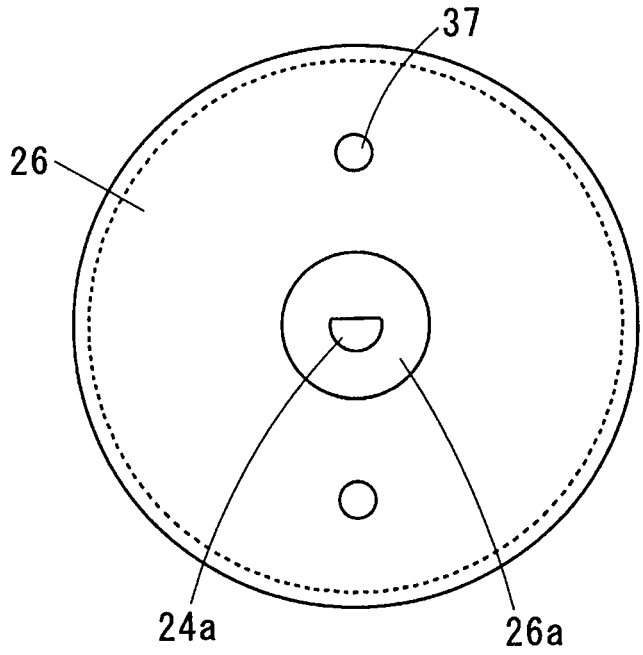
FIG. 14 is a plan view illustrating the impeller according to the sixth embodiment.
Figure 15:
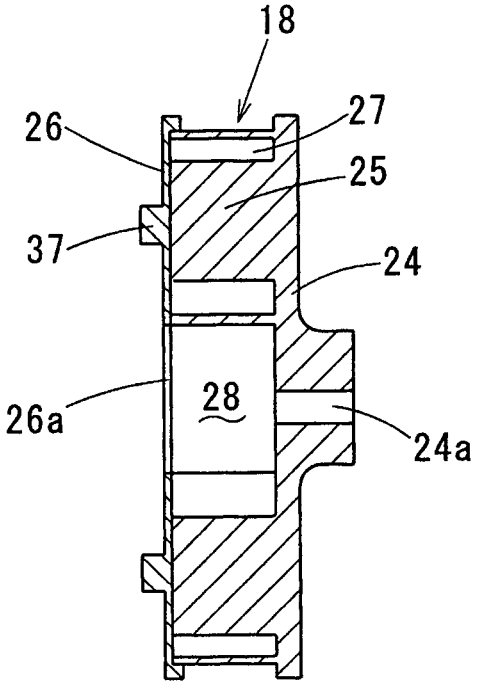
FIG. 15 is a cross-sectional diagram illustrating the impeller according to the sixth embodiment.
Figure 16:
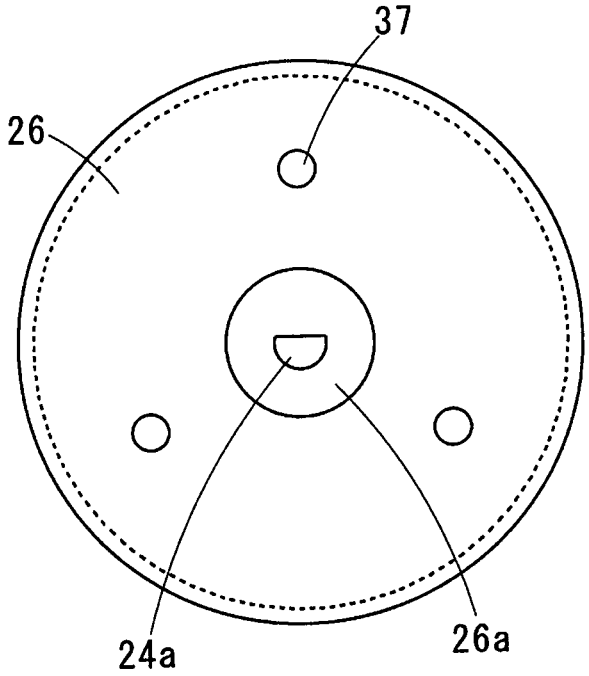
FIG. 16 is a plan view illustrating the impeller according to the sixth embodiment.
Figure 17:
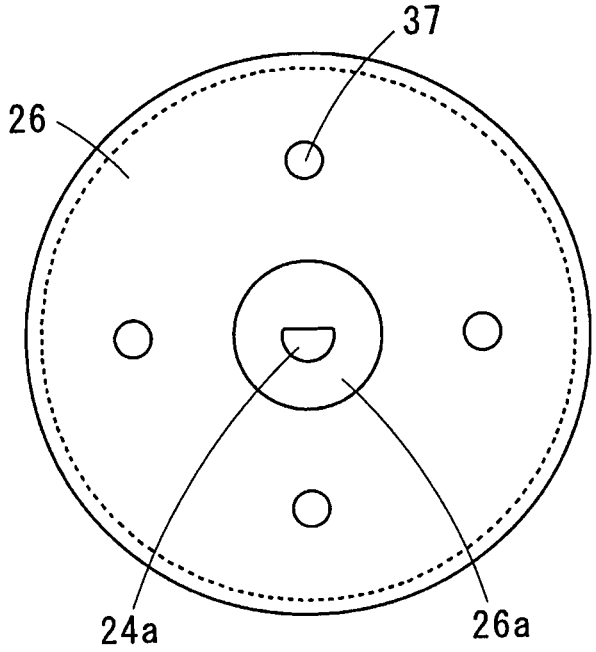
FIG. 17 is a plan view illustrating the impeller according to the sixth embodiment.

In the centrifugal pump 1 according to a sixth embodiment, a side panel protrusion 37 extends from a surface of the side panel 26 opposite from the passage wall as shown in FIG. 13, and the side panel protrusion 37 is used as the engagement portion of the present disclosure. Two side panel protrusions 37 are provided at positions 180-degree different from each other, as shown in FIGS. 14, 15. Three side panel protrusions 37 may be provided at 120-degree intervals in the circumferential direction of the side panel as shown in FIG. 16. Four side panel protrusions 37 may be provided at 90-degree intervals in the circumferential direction. Five or more side panel protrusions 37 may be arranged at a regular intervals in the circumferential direction.

A positioning recess portion 31*c* configured to be engaged with the side panel protrusion 37 is provided in the flat plate portion 31*a* of the jig cover 31, as shown in FIG. 13. Since the rotation of the impeller 18 is limited by the engagement of the side panel protrusion 37 and the positioning recess portion 31*c*, the rotation of the shaft 10 can be limited when the impeller 18 is fixed to the shaft 10 by the nut 23. According to this, the same effects as the first embodiment can be obtained. In the configurations of the sixth embodiment, since it is not necessary to provide the axial hole 25*a* in the passage wall 25, the tightening torque of the nut 23 is not exerted on the passage wall 25, and accordingly the effect of increasing pressure of the fluid flowing through the fluid passage 27 is not decreased. Since the side panel protrusion 37 is provided integrally with the side panel 26, the side panel protrusion 37 can be easily formed.

(Seventh Embodiment)

Figure 19:
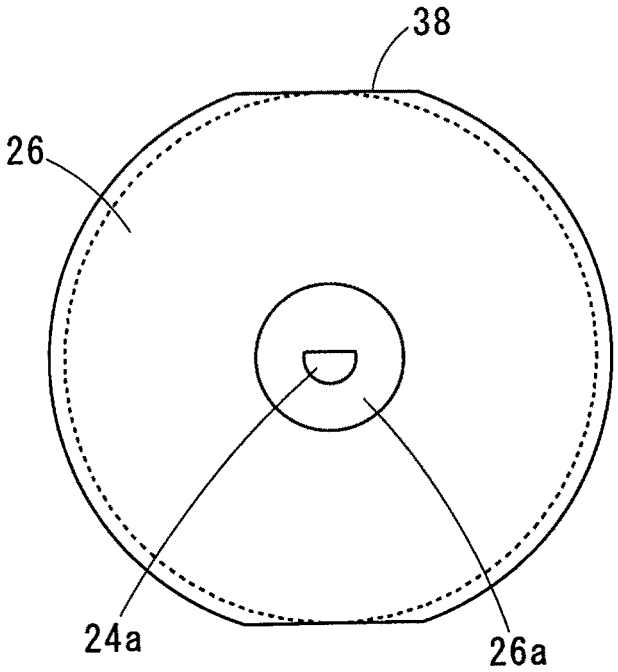
FIG. 19 is a plan view illustrating the impeller according to the seventh embodiment.
Figure 20:
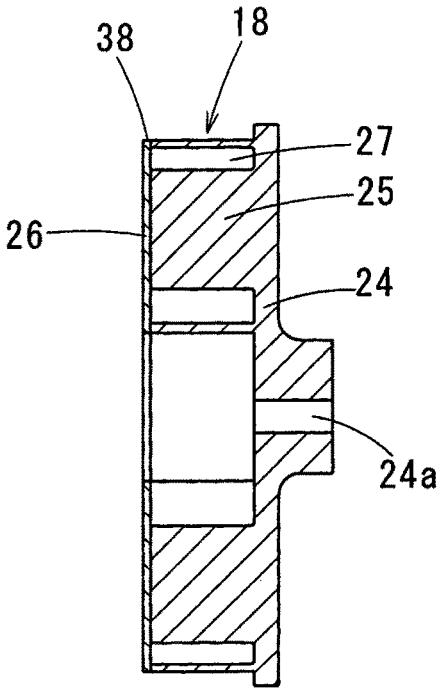
FIG. 20 is a cross-sectional diagram illustrating the impeller according to the seventh embodiment.

In an impeller 18 according to a seventh embodiment, an engagement surface 38 is provided in an outer periphery of the side panel 26 as shown in FIG. 19, and the engagement surface 38 is used as the engagement portion of the present disclosure. The engagement surface 38 has a shape that is formed by linearly cutting off a part of the outer periphery of the side panel 26, for example, and two engagement surfaces 38 are provided at parts of the side panel 180-degree different from each other. The engagement surface 38 is not inside of the outer periphery of the passage wall 25 as shown in FIG. 20. That is, the outer periphery of the passage wall 25 does not extend outward from the engagement surface 38.

Figure 18:
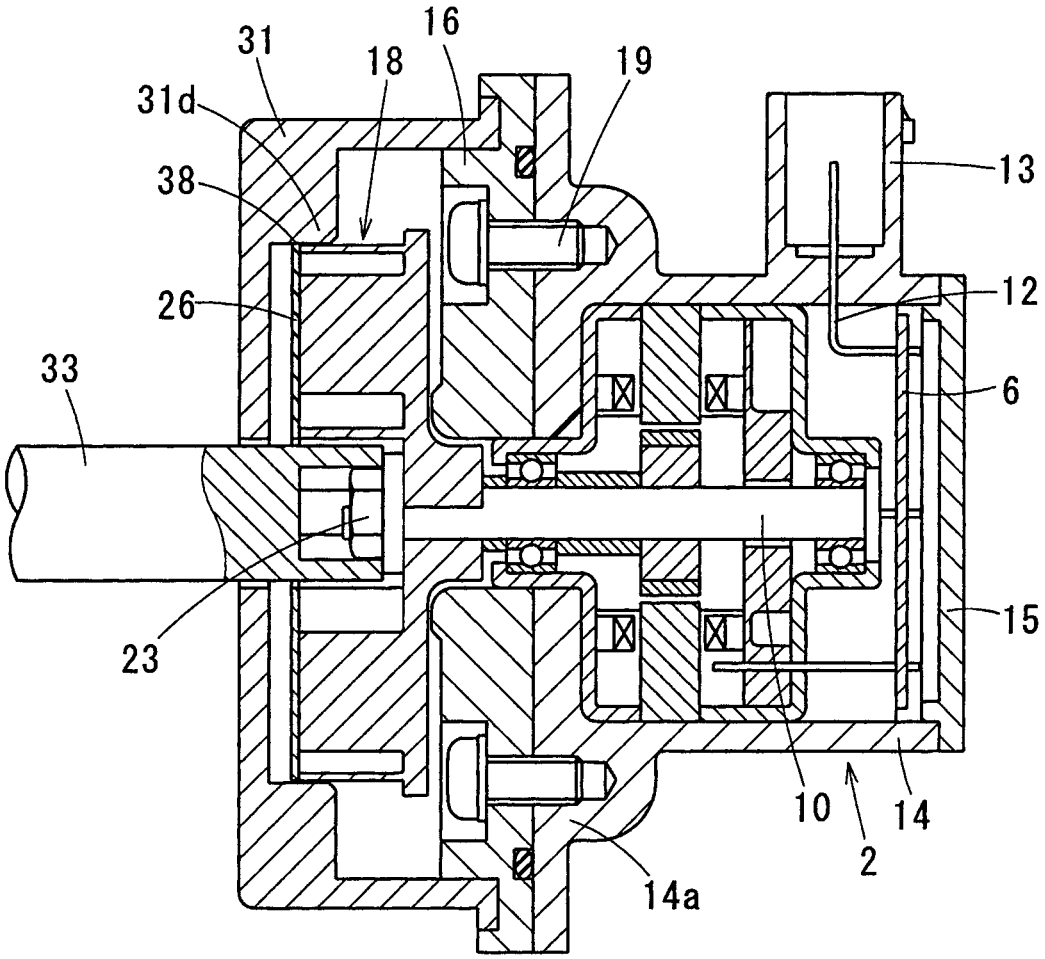
FIG. 18 is a cross-sectional diagram illustrating a situation where an impeller according to a seventh embodiment of the present disclosure is fixed to a shaft.

The jig cover 31 has an engagement step portion 31*d* engaged with the engagement surface 38, as shown in FIG. 18. Since the engagement of the engagement surface 38 and the engagement step portion 31*d* limits the rotation of the impeller 18, the rotation of the shaft 10 can be prevented when the impeller 18 is fixed to the shaft 10 by the nut 23, and accordingly the same effects as the first embodiment can be obtained. Moreover, since the engagement surface 38 is positioned in an outer periphery of the side panel 26, the engagement step portion 31*d* engaged with the engagement surface 38 does not interfere with the tightening of the nut 23.

Figure 21:
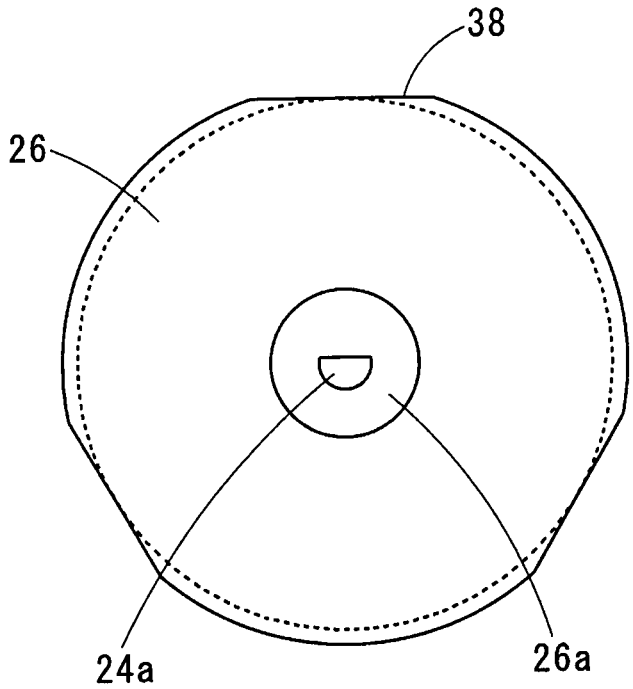
FIG. 21 is a plan view illustrating the impeller according to the seventh embodiment.
Figure 22:
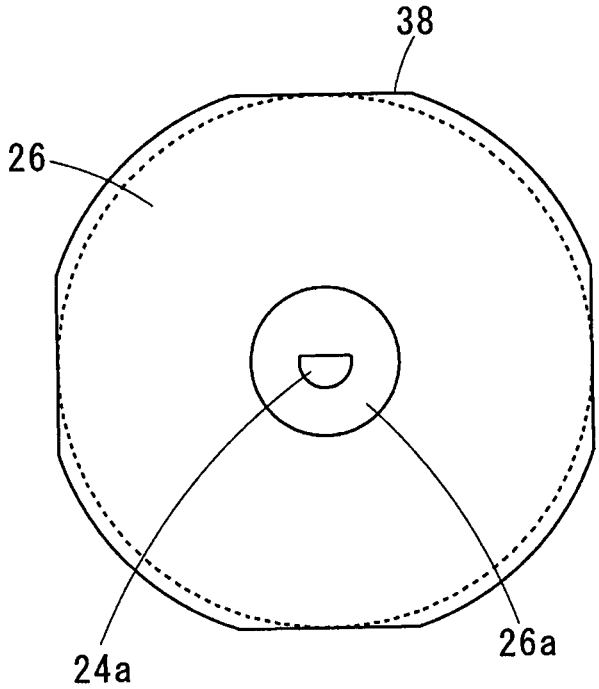
FIG. 22 is a plan view illustrating the impeller according to the seventh embodiment.

Three engagement surfaces 38 may be provided at 120-degree intervals in the circumferential direction of the side panel 26 as shown in FIG. 21. Four engagement surfaces 38 may be provided at 90-degree intervals in the circumferential direction as shown in FIG. 22. Five or more engagement surfaces 38 may be provided at regular intervals in the circumferential direction.

(Eighth Embodiment)

Figure 24:
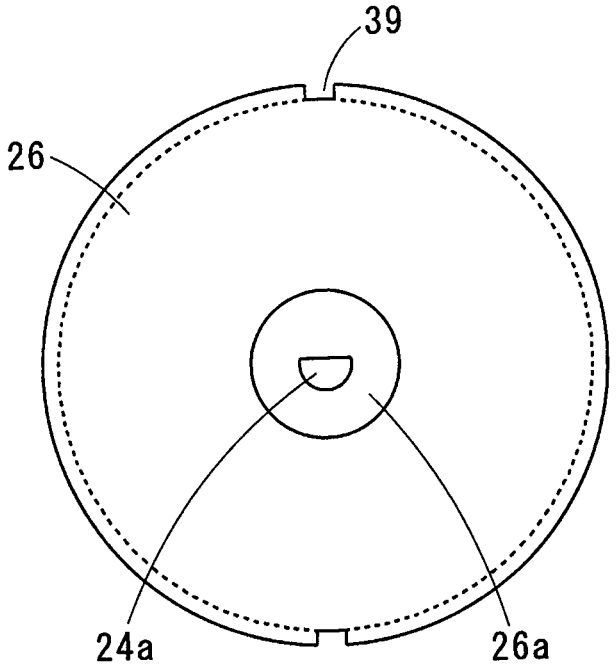
FIG. 24 is a plan view illustrating the impeller according to the eighth embodiment.
Figure 25:
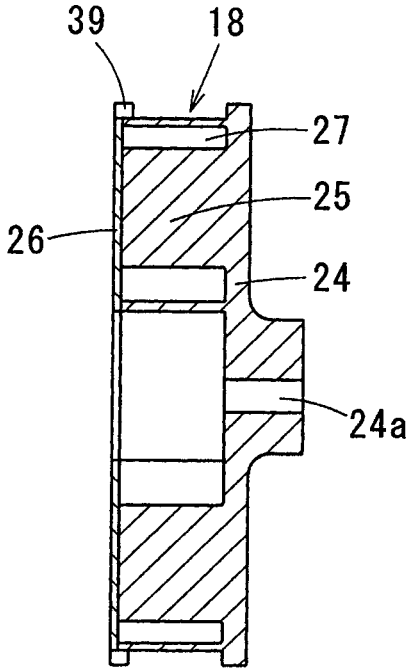
FIG. 25 is a cross-sectional diagram illustrating the impeller according to the eighth embodiment.

An impeller 18 of an eighth embodiment includes a notch 39 in the outer periphery of the side panel 26 as shown in FIG. 24, and the notch 39 is used as the engagement portion of the present disclosure. The notch 39 has a shape formed by cutting off the side panel 26 inward from an outer peripheral end to be a rectangular shape, and two notches 39 are provided at positions 180-degree different from each other, for example. The notch 39 is not located inside the outer periphery of the passage wall 25. That is, the outer periphery of the passage wall 25 does not extend outward from an innermost part of the notch 39.

Figure 23:
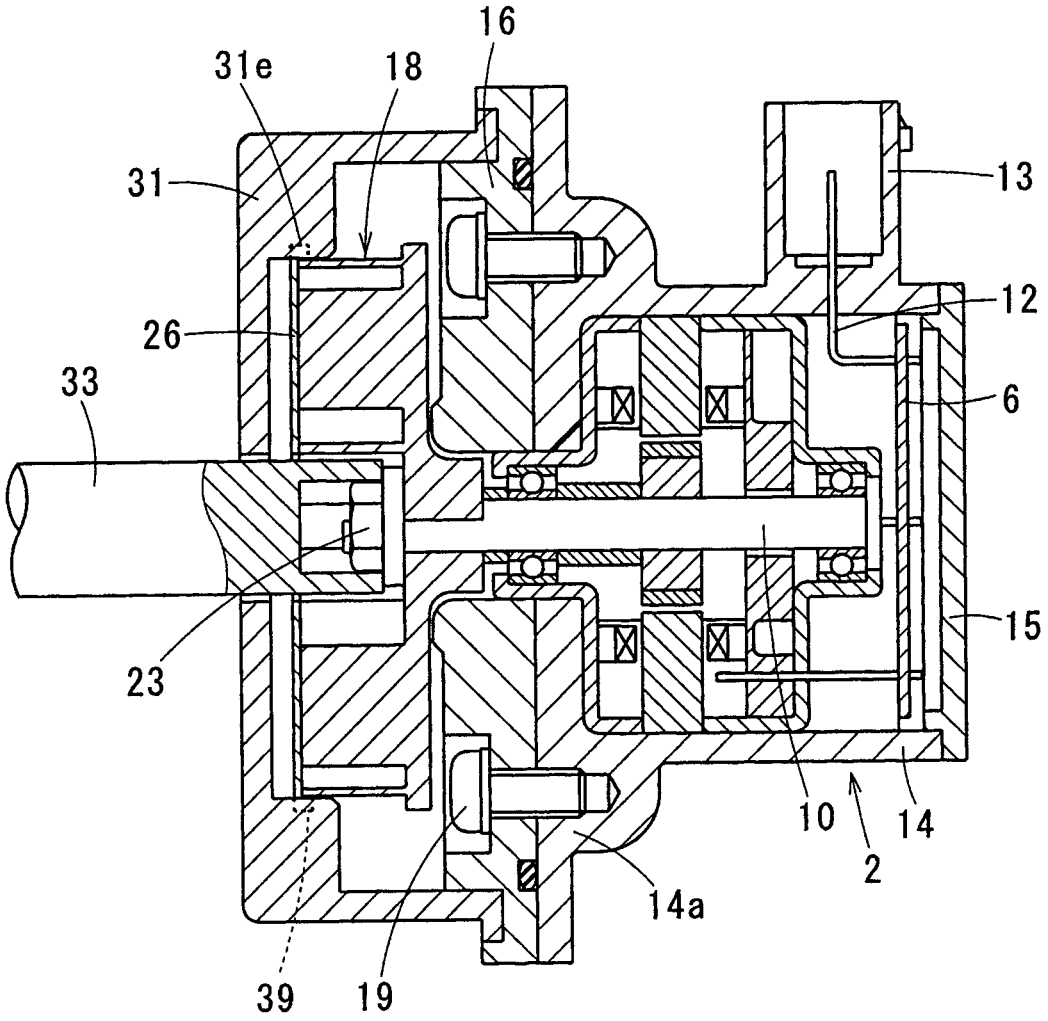
FIG. 23 is a cross-sectional diagram illustrating a situation where an impeller according to an eighth embodiment of the present disclosure is fixed to a shaft.

The jig cover 31 includes an engagement protrusion portion 31*e* configured to be engaged with the notch 39 as shown in FIG. 23. Since the engagement of the notch 39 and the engagement protrusion portion 31*e* limits the rotation of the impeller 18, the rotation of the shaft 10 can be prevented when the impeller 18 is fixed to the shaft 10 by the nut 23, and accordingly the same effects as the first embodiment can be obtained. Since the notch 39 is located on the outer periphery of the side panel 26, the engagement protrusion portion 31*e* engaged with the notch 39 does not interfere with the tightening of the nut 23.

Figure 26:
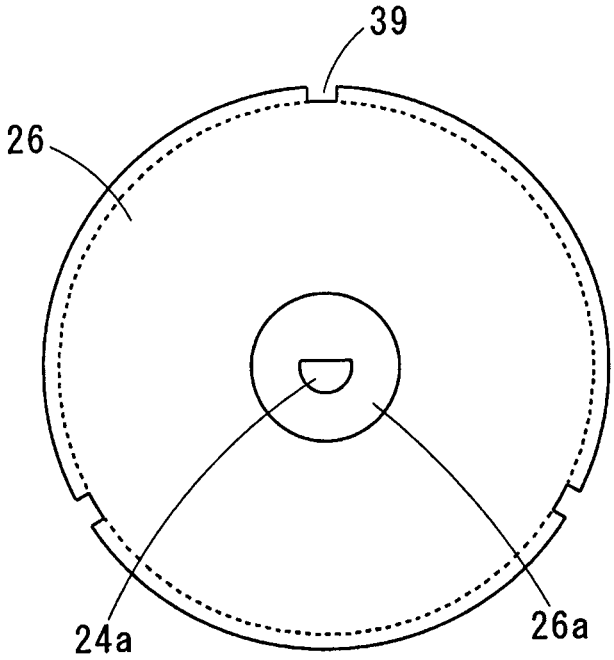
FIG. 26 is a plan view illustrating the impeller according to the eighth embodiment.
Figure 27:
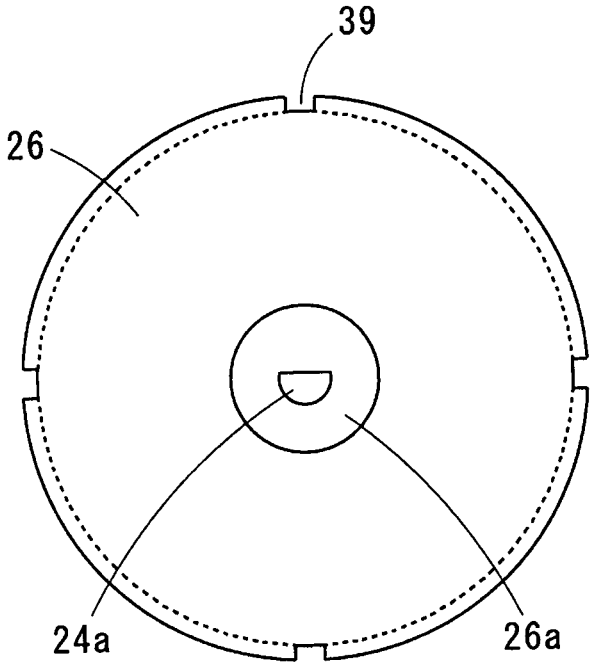
FIG. 27 is a plan view illustrating the impeller according to the eighth embodiment.

Three notches 39 may be provided at 120-degree intervals in the circumferential direction of the side panel 26, as shown in FIG. 26. Four notches may be provided at 90-degree intervals in the circumferential direction as shown in FIG. 27. Five or more notches may be provided at regular intervals in the circumferential direction.

(Modifications)

The motor 2 of the first embodiment includes the substrate 6 inside the motor housing, but the motor 2 may not have the substrate 6. In the second to fifth embodiments, all of four passage walls 25 include the bored space 25*b*, but the bored space 25*b* may be provided only in two passage walls 25 corresponding to the side panel holes 29.

Although the present disclosure has been fully described in connection with the preferred embodiments thereof, it is to be noted that various changes and modifications will become apparent to those skilled in the art. Moreover, other combinations and configurations, including more, less or only a single element, are also within the spirit and scope of the present disclosure.

The invention claimed is:

1. A centrifugal pump comprising:

a motor that has a shaft, and an impeller that is engaged with an end portion of the shaft such that a rotation of the impeller relative to the shaft is limited, a nut fixing the impeller to the shaft, the end portion of the shaft being located on a first side of the shaft, wherein the impeller includes a main panel that is engaged with the shaft, a plurality of passage walls that extend from the main panel in an axial direction, a side panel that is in contact with end surfaces of the plurality of the passage walls that face away from the main panel, the side panel having an inflow opening at a radially center part, and a fluid passage that is defined by two of the plurality of passage walls which are adjacent to each other in a circumferential direction, the two adjacent passage walls being located between the main panel and the side panel, the fluid passage communicating with the inflow opening, the impeller is configured to rotate to intake a fluid into the fluid passage through the inflow opening, a pressure of the fluid taken into the fluid passage being increased by a centrifugal pressure, the fluid being discharged radially outward of the impeller, and the side panel includes an engagement portion configured to be engaged with a fixation jig that limits a rotation of the impeller during fixing the impeller to the shaft by screwing the nut.

2. The centrifugal pump according to claim 1, wherein the engagement portion is a side panel hole that extends through the side panel in a thickness direction of the side panel, at least one passage wall of the plurality of passage walls has an axial hole that communicates with the side panel hole and extends in the axial direction, and the fixation jig includes a jig pin that is inserted into the axial hole through the side panel hole.

3. The centrifugal pump according to claim 1, wherein the engagement portion is a side panel hole that extends through the side panel in a thickness direction of the side panel, at least one passage wall of the plurality of passage walls includes a bored space in which a material of the at least one passage wall is partially removed, the side panel hole opens to the bored space, and the fixation jig includes a jig pin configured to be inserted into the bored space through the side panel hole.

4. The centrifugal pump according to claim 3 further comprising:

a rib wall that extends from the main panel in the bored space, wherein a tightening torque of the nut is exerted on the rib wall through the jig pin.

5. The centrifugal pump according to claim 2, further comprising:

a rib wall, wherein at least one passage wall of the plurality of passage walls includes a bored space in which a material of the at least one passage wall is partially removed, the side panel hole opens to the bored space, the rib wall extends from the main panel in the bored space, a tightening torque of the nut is exerted on the rib wall through the jig pin, and an inside space of the rib wall is the axial hole.

6. The centrifugal pump according to claim 1, wherein the engagement portion is a side panel protrusion that protrudes from a side of the side panel facing away from at least one passage wall of the plurality of passage walls, the fixation jig includes a jig cover that has a positioning recess portion at a position corresponding to the side panel protrusion, and the side panel protrusion is configured to be engaged with the positioning recess portion to limit the rotation of the shaft.

7. The centrifugal pump according to claim 1, wherein the side panel has a disc shape, the engagement portion is an engagement surface formed as a part of an outer periphery of the side panel, the fixation jig includes a jig cover that has an engagement step portion in an inner periphery, and the engagement surface is configured to be engaged with the engagement step portion to limit the rotation of the shaft.

8. The centrifugal pump according to claim 1, wherein the side panel has a disc shape, the engagement portion is a notch formed in a part of an outer periphery of the side panel, the fixation jig includes a jig cover that has an engagement protrusion portion in an inner periphery, and the notch is configured to be engaged with the engagement protrusion portion to limit the rotation of the shaft.

9. The centrifugal pump according to claim 1, wherein a plurality of the engagement portions are provided at regular intervals in a circumferential direction of the side panel.

10. A method for manufacturing the centrifugal pump according to claim 1, the method comprising:

engaging the impeller with the end portion of the shaft on the first side such that the shaft does not rotate relatively to the impeller, and fixing the impeller to the shaft by screwing the nut in a condition where the fixation jig is engaged with the engagement portion to limit the rotation of the impeller.

11. The centrifugal pump according to claim 1, wherein the engagement portion is a side panel hole that extends through the side panel in a thickness direction of the side panel, and at least one passage wall of the plurality of passage walls has an axial hole that communicates with the side panel hole and extends in the axial direction.

12. The centrifugal pump according to claim 1, wherein the engagement portion is a side panel hole that extends through the side panel in a thickness direction of the side panel, at least one passage wall of the plurality of passage walls includes a bored space in which a material of the at least one passage wall is partially removed, and the side panel hole opens to the bored space.

13. The centrifugal pump according to claim 12 further comprising:

a rib wall that extends from the main panel in the bored space.

14. The centrifugal pump according to claim 11, wherein at least one passage wall of the plurality of passage walls includes a bored space in which a material of the at least one passage wall is partially removed, and the side panel hole opens to the bored space.

15. The centrifugal pump according to claim 14 further comprising:

a rib wall that extends from the main panel in the bored space, wherein an inside space of the rib wall is the axial hole.

16. The centrifugal pump according to claim 1, wherein the engagement portion is a side panel protrusion that protrudes from a side of the side panel facing away from at least one passage wall of the plurality of passage walls.

17. The centrifugal pump according to claim 1, wherein the side panel has a disc shape, and the engagement portion is an engagement surface formed as a part of an outer periphery of the side panel.

18. The centrifugal pump according to claim 1, wherein the side panel has a disc shape, the engagement portion is a notch formed in a part of an outer periphery of the side panel.

19. The centrifugal pump according to claim 11, wherein a plurality of the engagement portions are provided at regular intervals in a circumferential direction of the side panel.

20. A method for manufacturing the centrifugal pump according to claim 11, the method comprising:

engaging the impeller with the end portion of the shaft on the first side such that the shaft does not rotate relatively to the impeller, and fixing the impeller to the shaft by screwing the nut in a condition where the fixation jig is engaged with the engagement portion to limit the rotation of the impeller.

* * * * *